US010600609B2

(12) United States Patent
Bendahan et al.

(10) Patent No.: US 10,600,609 B2
(45) Date of Patent: Mar. 24, 2020

(54) HIGH-POWER X-RAY SOURCES AND METHODS OF OPERATION

(71) Applicant: Rapiscan Systems, Inc., Torrance, CA (US)

(72) Inventors: Joseph Bendahan, San Jose, CA (US); Robert Thomas Wiggers, Belmont, CA (US)

(73) Assignee: Rapiscan Systems, Inc., Torrance, CA (US)

( * ) Notice: Subject to any disclaimer, the term of this patent is extended or adjusted under 35 U.S.C. 154(b) by 120 days.

(21) Appl. No.: 15/885,601

(22) Filed: Jan. 31, 2018

(65) Prior Publication Data

US 2019/0043686 A1 Feb. 7, 2019

Related U.S. Application Data

(60) Provisional application No. 62/452,756, filed on Jan. 31, 2017.

(51) Int. Cl.
*H01J 35/10* (2006.01)

(52) U.S. Cl.
CPC ..... *H01J 35/106* (2013.01); *H01J 35/101* (2013.01); *H01J 2235/1026* (2013.01); *H01J 2235/1053* (2013.01); *H01J 2235/127* (2013.01); *H01J 2235/1279* (2013.01)

(58) Field of Classification Search
CPC ..... H01J 35/101; H01J 35/106; H01J 2235/1026; H01J 2235/1053; H01J 2235/127; H01J 2235/1279
See application file for complete search history.

(56) References Cited

U.S. PATENT DOCUMENTS

| | | | |
|---|---|---|---|
| 2,250,322 | A | 7/1941 | Atlee |
| 2,636,619 | A | 4/1953 | Alexander |
| 3,275,831 | A | 9/1966 | Martin |
| 3,374,355 | A | 3/1968 | Parratt |
| 3,439,166 | A | 4/1969 | Chope |
| 3,837,502 | A | 9/1974 | Hornagold |

(Continued)

FOREIGN PATENT DOCUMENTS

| | | | |
|---|---|---|---|
| CN | 101006929 | A | 8/2007 |
| DE | 8713042 | U1 | 1/1989 |

(Continued)

OTHER PUBLICATIONS

Heikkinen et al: "Tritium-Target Performance at RTNS-II", Lawrence Livermore National Laboratory, Livermore, CA 94550, 1983.

(Continued)

*Primary Examiner* — Mark R Gaworecki
(74) *Attorney, Agent, or Firm* — Novel IP

(57) ABSTRACT

The present specification discloses a high power continuous X-ray source having a rotating target assembly that is cooled by circulation of a liquid material in contact with the target assembly, whereby the target assembly has a front surface being impinged by electrons and a mechanism for rotating the target assembly. The cooling liquid is always in contact with at least one surface of the target for dissipating the heat generated by the energy deposited by the stream of electrons, thereby lowering the temperature of the target to allow for continuous operation.

21 Claims, 9 Drawing Sheets

(56) References Cited

U.S. PATENT DOCUMENTS 3,904,923 A 9/1975 Schwartz
4,164,138 A 8/1979 Burkhart
4,165,472 A * 8/1979 Wittry ..... H01J 35/106 313/30
4,239,969 A 12/1980 Galetta
4,352,021 A 9/1982 Boyd
4,523,327 A * 6/1985 Eversole ..... H01J 35/10 378/124
4,658,408 A 4/1987 Amor
4,943,989 A 7/1990 Lounsberry
4,945,562 A 7/1990 Staub
5,014,293 A 5/1991 Boyd
5,041,728 A 8/1991 Spacher
5,065,418 A 11/1991 Bermbach
5,091,924 A 2/1992 Bermbach
5,168,241 A 12/1992 Hirota
5,181,234 A 1/1993 Smith
5,185,778 A 2/1993 Magram
5,197,088 A 3/1993 Vincent
5,202,932 A 4/1993 Cambier
5,259,012 A 11/1993 Baker
5,363,940 A 11/1994 Fahrion
5,491,734 A 2/1996 Boyd
5,493,596 A 2/1996 Annis
5,503,424 A 4/1996 Agopian
5,504,791 A 4/1996 Hell
5,508,515 A 4/1996 Enge
5,600,303 A 2/1997 Husseiny
5,606,167 A 2/1997 Miller
5,692,028 A 11/1997 Geus
5,692,029 A 11/1997 Husseiny
5,818,054 A 10/1998 Randers-Pehrson
5,842,578 A 12/1998 Cordeiro
5,909,478 A 6/1999 Polichar
5,910,973 A 6/1999 Grodzins
5,940,468 A 8/1999 Huang
5,974,111 A 10/1999 Krug
6,056,671 A 5/2000 Marmer
6,067,344 A 5/2000 Grodzins
6,081,580 A 6/2000 Grodzins
6,151,381 A 11/2000 Grodzins
6,192,104 B1 2/2001 Adams
6,216,540 B1 4/2001 Nelson
6,220,099 B1 4/2001 Marti
6,249,567 B1 6/2001 Rothschild
6,292,533 B1 9/2001 Swift
6,301,327 B1 10/2001 Martens
6,320,933 B1 11/2001 Grodzins
6,347,132 B1 2/2002 Annis
6,418,194 B1 7/2002 McPherson
6,421,420 B1 7/2002 Grodzins
6,424,695 B1 7/2002 Grodzins
6,459,761 B1 10/2002 Grodzins
6,459,764 B1 10/2002 Chalmers
6,542,574 B2 4/2003 Grodzins
6,542,580 B1 4/2003 Carver
6,546,072 B1 4/2003 Chalmers
6,552,346 B2 4/2003 Verbinski
6,614,872 B2 9/2003 Bueno
6,628,745 B1 9/2003 Annis
6,658,087 B2 12/2003 Chalmers
6,665,373 B1 12/2003 Kotowski
6,702,459 B2 3/2004 Barnes
6,713,773 B1 3/2004 Lyons
6,735,279 B1 5/2004 Jacobs
6,843,599 B2 1/2005 Le
6,920,197 B2 7/2005 Kang
6,924,487 B2 8/2005 Bolozdynya
6,928,141 B2 8/2005 Carver
7,010,094 B2 3/2006 Grodzins
7,046,768 B1 5/2006 Gilevich
7,099,434 B2 8/2006 Adams
RE39,396 E 11/2006 Swift
7,151,447 B1 12/2006 Willms
7,203,276 B2 4/2007 Arsenault
7,207,713 B2 4/2007 Lowman
7,215,738 B2 5/2007 Muenchau
7,218,704 B1 5/2007 Adams
7,233,644 B1 6/2007 Bendahan
7,322,745 B2 1/2008 Agrawal
7,366,282 B2 4/2008 Peschmann
7,369,643 B2 5/2008 Kotowski
7,379,530 B2 5/2008 Hoff
7,397,891 B2 7/2008 Johnson
7,400,701 B1 7/2008 Cason
7,417,440 B2 8/2008 Peschmann
7,418,077 B2 8/2008 Gray
7,453,987 B1 11/2008 Richardson
7,471,764 B2 12/2008 Kaval
7,483,510 B2 1/2009 Carver
7,486,768 B2 2/2009 Allman
7,505,556 B2 3/2009 Chalmers
7,517,149 B2 4/2009 Agrawal
7,519,148 B2 4/2009 Kotowski
7,525,101 B2 4/2009 Grodzins
7,526,064 B2 4/2009 Akery
7,538,325 B2 5/2009 Mishin
7,555,099 B2 6/2009 Rothschild
7,579,845 B2 8/2009 Peschmann
7,593,506 B2 9/2009 Cason
7,593,510 B2 9/2009 Rothschild
7,646,851 B2 1/2010 Liu
7,660,388 B2 2/2010 Gray
7,720,195 B2 5/2010 Allman
7,742,568 B2 6/2010 Smith
7,769,133 B2 8/2010 Carver
7,783,004 B2 8/2010 Kotowski
7,783,005 B2 8/2010 Kaval
7,817,776 B2 10/2010 Agrawal
7,856,081 B2 12/2010 Peschmann
7,860,213 B2 12/2010 Akery
7,864,920 B2 1/2011 Rothschild
7,876,879 B2 1/2011 Morton
7,876,880 B2 1/2011 Kotowski
7,915,596 B2 3/2011 Clothier
7,928,400 B1 4/2011 Diawara
7,963,695 B2 6/2011 Kotowski
7,982,191 B2 7/2011 Friedman
7,991,133 B2 8/2011 Mills
7,995,705 B2 8/2011 Allman
7,995,707 B2 8/2011 Rothschild
8,054,938 B2 11/2011 Kaval
8,059,781 B2 11/2011 Agrawal
8,073,099 B2 12/2011 Niu
8,135,110 B2 3/2012 Morton
8,138,770 B2 3/2012 Peschmann
8,170,177 B2 5/2012 Akery
8,243,876 B2 8/2012 Morton
8,275,091 B2 9/2012 Morton
8,284,898 B2 10/2012 Ho
8,325,871 B2 12/2012 Grodzins
8,345,819 B2 1/2013 Mastronardi
8,356,937 B2 1/2013 Kotowski
8,385,501 B2 2/2013 Allman
8,389,942 B2 3/2013 Morton
8,428,217 B2 4/2013 Peschmann
8,433,036 B2 4/2013 Morton
8,439,565 B2 5/2013 Mastronardi
8,442,186 B2 5/2013 Rothschild
8,457,274 B2 6/2013 Arodzero
8,457,275 B2 6/2013 Akery
8,483,356 B2 7/2013 Bendahan
8,491,189 B2 7/2013 Kotowski
8,503,605 B2 8/2013 Morton
8,503,606 B2 8/2013 Rothschild
8,532,823 B2 9/2013 McElroy
8,579,506 B2 11/2013 Morton
8,604,723 B2 12/2013 Chen
8,644,453 B2 2/2014 Morton
8,668,386 B2 3/2014 Morton
8,674,706 B2 3/2014 Peschmann
8,687,765 B2 4/2014 Kotowski
8,690,427 B2 4/2014 Mastronardi
8,735,833 B2 5/2014 Morto

(56) References Cited

U.S. PATENT DOCUMENTS 8,750,452 B2 6/2014 Kaval
8,774,357 B2 7/2014 Morton
8,798,232 B2 8/2014 Bendahan
8,824,632 B2 9/2014 Mastronardi
8,831,176 B2 9/2014 Morto
8,837,670 B2 9/2014 Akery
8,840,303 B2 9/2014 Morton
8,842,808 B2 9/2014 Rothschild
8,861,684 B2 10/2014 Al-Kofahi
8,908,831 B2 12/2014 Bendahan
8,929,509 B2 1/2015 Morton
8,958,526 B2 2/2015 Morton
8,971,485 B2 3/2015 Morton
8,971,487 B2 3/2015 Mastronardi
8,993,970 B2 3/2015 Morton
9,014,339 B2 4/2015 Grodzins
9,020,095 B2 4/2015 Morton
9,020,096 B2 4/2015 Allman
9,020,103 B2 4/2015 Grodzins
9,025,731 B2 5/2015 Kotowski
9,042,511 B2 5/2015 Peschmann
9,052,271 B2 6/2015 Grodzins
9,052,403 B2 6/2015 Morton
9,057,679 B2 6/2015 Morton
9,086,497 B2 7/2015 Bendahan
9,099,279 B2 8/2015 Rommel
9,111,331 B2 8/2015 Parikh
9,117,564 B2 8/2015 Rommel
9,121,958 B2 9/2015 Morton
9,146,201 B2 9/2015 Schubert
9,158,027 B2 10/2015 Morton
9,218,933 B2 12/2015 Langeveld
9,223,049 B2 12/2015 Kotowski
9,223,050 B2 12/2015 Kaval
9,223,052 B2 12/2015 Morton
9,257,208 B2 2/2016 Rommel
9,268,058 B2 2/2016 Peschmann
9,274,065 B2 3/2016 Morton
9,279,901 B2 3/2016 Akery
9,285,488 B2 3/2016 Arodzero
9,285,498 B2 3/2016 Carver
9,291,582 B2 3/2016 Grodzins
9,310,322 B2 4/2016 Panesar
9,310,323 B2 4/2016 Bendahan
9,316,760 B2 4/2016 Bendahan
9,329,285 B2 5/2016 Gozani
9,332,624 B2 5/2016 Morton
9,417,060 B1 8/2016 Schubert
9,465,135 B2 10/2016 Morton
9,466,456 B2 10/2016 Rommel
9,535,019 B1 1/2017 Rothschild
9,541,510 B2 1/2017 Arodzero
9,622,333 B2 4/2017 Nighan, Jr.
9,658,343 B2 5/2017 Arodzero
2002/0094064 A1 7/2002 Zhou
2003/0043964 A1 3/2003 Sorenson
2003/0068557 A1 4/2003 Kumashiro
2004/0017888 A1 1/2004 Seppi
2004/0051265 A1 3/2004 Nadeau
2004/0081269 A1 4/2004 Pan
2004/0109532 A1 6/2004 Ford
2004/0120454 A1 6/2004 Ellenbogen
2004/0141584 A1 7/2004 Bernardi
2004/0252024 A1 12/2004 Huey
2004/0258198 A1 12/2004 Carver
2005/0023479 A1 2/2005 Grodzins
2005/0024199 A1 2/2005 Huey
2005/0053185 A1 3/2005 Sukovic
2005/0100135 A1 5/2005 Lowman
2005/0117683 A1 6/2005 Mishin
2005/0117694 A1 6/2005 Francke
2005/0135668 A1 6/2005 Polichar
2005/0157842 A1 7/2005 Agrawal
2005/0169421 A1 8/2005 Muenchau
2005/0198226 A1 9/2005 Delia
2005/0226364 A1 10/2005 Bernard
2006/0002515 A1 1/2006 Huber
2006/0027751 A1 2/2006 Kurita
2006/0056584 A1 3/2006 Allman
2006/0114477 A1 6/2006 Cox
2006/0140341 A1 6/2006 Carver
2006/0182221 A1 8/2006 Bernhardt
2006/0249685 A1 11/2006 Tanaka
2006/0257005 A1 11/2006 Bergeron
2006/0284094 A1 12/2006 Inbar
2007/0085010 A1 4/2007 Letant
2007/0140422 A1 6/2007 Elyan
2007/0140423 A1 6/2007 Foland
2007/0170375 A1 7/2007 Tang
2007/0172129 A1 7/2007 Tortora
2007/0189454 A1 8/2007 Georgeson
2007/0210255 A1 9/2007 Bjorkholm
2007/0228284 A1 10/2007 Polichar
2007/0237293 A1 10/2007 Singh
2007/0280502 A1 12/2007 Paresi
2008/0037707 A1 2/2008 Rothschild
2008/0043910 A1 2/2008 Thomas
2008/0048872 A1 2/2008 Frank
2008/0084963 A1 4/2008 Clayton
2008/0128624 A1 6/2008 Cooke
2008/0137805 A1 6/2008 Forster
2008/0159591 A1 7/2008 Ruedin
2008/0170670 A1 7/2008 Bhatt
2008/0198970 A1 8/2008 Kirshner
2008/0205594 A1 8/2008 Bjorkholm
2008/0211431 A1 9/2008 Mishin
2008/0230709 A1 9/2008 Tkaczyk
2008/0260097 A1 10/2008 Anwar
2008/0304622 A1 12/2008 Morton
2009/0067575 A1 3/2009 Seppi
2009/0086907 A1 4/2009 Smith
2009/0116617 A1 5/2009 Mastronardi
2009/0127459 A1 5/2009 Neustadter
2009/0168964 A1 7/2009 Safai
2009/0238336 A1 9/2009 Akery
2009/0245462 A1 10/2009 Agrawal
2009/0257555 A1 10/2009 Chalmers
2009/0285353 A1 11/2009 Ellenbogen
2009/0292050 A1 11/2009 He
2009/0316851 A1 12/2009 Oosaka
2010/0020937 A1 1/2010 Hautmann
2010/0066256 A1 3/2010 Meddaugh
2010/0111260 A1 5/2010 Motz
2010/0127169 A1 5/2010 Whittum
2010/0161504 A1 6/2010 Casey
2010/0177868 A1 7/2010 Smith
2010/0177873 A1 7/2010 Chen
2010/0188027 A1 7/2010 Treas
2010/0202593 A1* 8/2010 Spence ..... A61B 6/4488 378/204
2010/0295689 A1 11/2010 Armistead
2011/0019797 A1 1/2011 Morton
2011/0019799 A1 1/2011 Shedlock
2011/0038453 A1 2/2011 Morton
2011/0064192 A1 3/2011 Morton
2011/0075808 A1 3/2011 Rothschild
2011/0103554 A1 5/2011 Charette
2011/0204243 A1 8/2011 Bendahan
2011/0206179 A1 8/2011 Bendahan
2011/0235777 A1 9/2011 Gozani
2011/0266643 A1 11/2011 Engelmann
2012/0081042 A1 4/2012 Cheung
2012/0099710 A1 4/2012 Kotowski
2012/0104276 A1 5/2012 Miller
2012/0116720 A1 5/2012 Klann
2012/0206069 A1 8/2012 Zavadtsev
2012/0294423 A1 11/2012 Cheung
2012/0321049 A1 12/2012 Langeveld
2013/0001048 A1 1/2013 Panesar
2013/0016814 A1 1/2013 Treas
2013/0063052 A1 3/2013 Ho
2014/0029725 A1 1/2014 Ueda
2014/0185771 A1 7/2014 Morton
2014/0197321 A1 7/2014 Bendahan

(56) References Cited

U.S. PATENT DOCUMENTS

| | | | |
|---|---|---|---|
| 2014/0211919 | A1 | 7/2014 | Ogura |
| 2014/0270086 | A1 | 9/2014 | Krasnykh |
| 2015/0036798 | A1 | 2/2015 | Morton |
| 2015/0078519 | A1 | 3/2015 | Morton |
| 2015/0301220 | A1 | 10/2015 | Morton |
| 2015/0355117 | A1 | 12/2015 | Morton |
| 2015/0355369 | A1 | 12/2015 | Morton |
| 2016/0025889 | A1 | 1/2016 | Morton |
| 2016/0033674 | A1 | 2/2016 | Allman |

FOREIGN PATENT DOCUMENTS

| | | | | | |
|---|---|---|---|---|---|
| DE | 19756697 | | | 7/1999 | |
| EP | 0077018 | A1 | | 4/1983 | |
| EP | 0919186 | A2 | | 6/1999 | |
| EP | 0672332 | B1 | | 2/2000 | |
| EP | 1413898 | A1 | | 4/2004 | |
| EP | 1875866 | | | 1/2008 | |
| EP | 1907831 | A2 | | 4/2008 | |
| GB | 2212975 | A | * | 8/1989 | ..... H01J 35/06 |
| GB | 2255634 | A | | 11/1992 | |
| GB | 2409268 | A | | 6/2005 | |
| GB | 2424065 | A | | 9/2006 | |
| GB | 2438317 | A | | 11/2007 | |
| JP | 201351156 | A | | 3/2013 | |
| WO | 9855851 | A1 | | 12/1998 | |
| WO | 2004010127 | A1 | | 1/2004 | |
| WO | 2005098400 | A2 | | 10/2005 | |
| WO | 2006036076 | A1 | | 4/2006 | |
| WO | 2006053279 | A2 | | 5/2006 | |
| WO | 2006078691 | A2 | | 7/2006 | |
| WO | 2007035359 | A2 | | 3/2007 | |
| WO | 2007055720 | A2 | | 5/2007 | |
| WO | 2007068933 | A1 | | 6/2007 | |
| WO | 2007103216 | A2 | | 9/2007 | |
| WO | 2008017983 | A2 | | 2/2008 | |
| WO | 2008027706 | | | 3/2008 | |
| WO | 2009106803 | A2 | | 9/2009 | |
| WO | 2009143169 | A1 | | 11/2009 | |
| WO | 2010141101 | | | 12/2010 | |
| WO | 2011069024 | A1 | | 6/2011 | |
| WO | 2011091070 | A2 | | 7/2011 | |
| WO | 2013116549 | | | 8/2013 | |
| WO | 2013119423 | A1 | | 8/2013 | |
| WO | 2014107675 | | | 7/2014 | |
| WO | 2014121097 | A1 | | 8/2014 | |
| WO | 2014124152 | A2 | | 8/2014 | |
| WO | 2014182685 | A1 | | 11/2014 | |
| WO | 2016011205 | | | 1/2016 | |

OTHER PUBLICATIONS

International Search Report for PCT/US2018/016284, dated Jun. 15, 2018.

CRS Report for Congress, Aviation Security Technologies and Procedures: Screening Passengers and Baggage, Oct. 26, 2001, pp. 1-12.

Molchanov P A et al: 'Nanosecond gated optical sensors for ocean optic applications' Sensors Applications Symposium, 2006. Proceedings of the 2006 IEEE Houston, Texas,USA Feb. 7-9, 2006, Piscataway, NJ, USA,IEEE, Feb. 7, 2006 (Feb. 7, 2006) , pp. 147-150, XP010917671 ISBN: 978-0-7803-9580-0.

Mobile X-Ray Inspection Systems, Internet Citation, Feb. 12, 2007, pp. 1-2, URL:http:// web.archive.org/web/20070212000928/http://www.bombdetecti- on.com/cat--details.php?catid=20.

Smith C. R. et al: 'Application of 450 kV computed tomography to engine blocks with steel liners' Materials Evaluation vol. 65, No. 5, 2007, pp. 458-461, XP055108238.

Miller, "Comparison of Standing-Wave and Travelling-Wave Structures", SLAC Linear Accelerator Conferernce, (1986).

Gao, "Analytical formula for the coupling coefficient Beta of a cavity waveguide coupling system", Physics Research A, vol. 309, pp. 5-10 (1991).

Ogorodnikov et al., "Processing of interlaced images in 4-10 MeV dual energy customs system for material recognition", Phys. Rev. Special Topics—Accelerators and Beam, vol. 5, 104701 (2002).

Krasnykh et al., "Concept of RF Linac for Intra-Pulse Multi-Energy Scan", SLAC Pub-15943, (Apr. 18, 2014).

* cited by examiner

HIGH-POWER X-RAY SOURCES AND METHODS OF OPERATION

CROSS-REFERENCE

The present application relies on U.S. Provisional Patent Application No. 62/452,756, entitled "High Power X-Ray Source and Method of Operating the Same" and filed on Jan. 31, 2017, for priority.

FIELD

The present specification generally relates to X-ray systems and in particular to high power, high-energy X-ray sources operating continuously comprising a rotating target cooled by circulating a fluid in communication with the target assembly.

BACKGROUND

High-power electron sources (up to 500 kW) have conventionally been used in X-ray irradiation applications, including food irradiation and sterilization. Usually, a pencil beam of electrons is rastered, which includes scanning an area from side to side while a conveyance system translates the object to cover the irradiated object. The electrons traverse a thin window that separates the source vacuum from air. The window can be easily cooled to prevent rupture since it is thin and since the electron beam is rastered, it spreads the electron energy over a large area. Thus, it is easier to cool than heat concentrated in a small spot.

In typical X-ray radiography, electrons in a beam impinge upon a stationary target to generate X-rays. The target is usually tungsten-rhenium brazed with copper that is cooled with chilled circulating water to remove the heat deposited by the electrons. High-energy X-ray inspection systems typically employ sources up to 1 kW that may include the use of this type of target. There are, however, emerging inspection applications where there is a need to increase power to approximately 20 kW to allow for greater penetration and enable new technologies. However, at these higher powers, the heat from the target cannot be removed fast enough to the point of target liquefaction, thus destroying the target.

Medical X-ray tubes used in Computed Tomography (CT) applications require very high power (up to 100 kW) with sub-millimetric focal spots. FIG. 1 illustrates a typical rotating anode X-ray tube 100 used in medical applications. Glass envelope 102 encloses a cathode 104 comprising a filament 106 in a focusing cup, and an anode/target 108 coupled with a tungsten/rhenium, anode disk 110 via an anode stem 114. In order to prevent melting of the anode/target 108 in such tubes, the target 108 is rotated at very high speed (~8,000 rpm) by using a motor comprising a rotor 109 and a stator 111, causing the heat within target 108 to dissipate over a large area. Since it is impractical to pass a rotating shaft through a high-vacuum seal, the rotating parts of the tube are positioned within the glass vacuum envelope 102 comprising a port 116 through which generated X-rays leave the tube 100. Temperature management is achieved by the heat storage capacity of the target 108. Since the heat removal by conduction is negligible and the heat storage capacity is limited, the tube 100 needs to be turned off for some time before turning it on again, thereby reducing the duty factor. Unlike medical applications, however, some security inspection systems require continuous operation.

Hence, there is a need for a high-power X-ray source that can be operated continuously and that does not have issues with overheating.

Another method that has been used for high-power targets is based on a liquid metal target. FIG. 2 illustrates a typical liquid metal target assembly for use in an X-ray source. At least a portion of the target 202 is cooled by a circulating liquid metal 204. A heat exchanger 206 is used to cool down the liquid metal 204 and a pump 208 is used to recirculate the liquid metal 204. The liquid metal 204 serves as both the X-ray production target as well as the cooling fluid, in that the heat generated by an electron beam 210 hitting the target surface 202 is carried away by the flowing stream of liquid metal 204. The advantage of this method is that it allows for continuous operation as the liquid metal can be cooled fast enough.

Possible liquid metals include liquid Gallium, which has high thermal conductivity, high volume specific heat and low kinetic viscosity. However, Gallium has a low atomic number (Z) of 32 as compared to Tungsten (Z=74), which results in lower X-ray conversion efficiency and a narrower Bremsstrahlung fan angle. Mercury is a liquid metal at room temperature with a high Z (80), however it is not usually used for this application due to its hazardous nature. A suitable metal alloy consists of 62.5% Ga, 21.5% In and 16% Sn. However, the atomic number of the aforementioned alloy is also quite low as compared to Tungsten. Another suitable alloy may be composed of elements having a higher Z, such as of 43% Bi, 21.7% Pb, 18.3% In, 8% Sn, 5% Cd and 4% Hg. However, Mercury, Cadmium and Lead are all hazardous materials. Another disadvantage of the liquid metal targets is that they require a thin window to separate the vacuum from the liquid target. The probability of such window rupturing and contaminating the vacuum is high.

Therefore, there is a need for a high-power X-ray production target that can be cooled in a safe and effective manner. Further, an X-ray tube with such a target should be capable of operating in a continuous mode.

SUMMARY

The following embodiments and aspects thereof are described and illustrated in conjunction with systems, tools and methods, which are meant to be exemplary and illustrative, and not limiting in scope. The present application discloses numerous embodiments.

In some embodiments, the present specification discloses a high power radiation production target assembly comprising: a target sub-assembly having a copper body and a target positioned along a periphery of the copper body, wherein said target is impinged by a stream of particles to produce radiation; a plurality of paddles positioned on said copper body; a stream of water to propel said paddles to cause rotation and cooling of said copper body; and, at least one coupling to provide vacuum sealing under rotation.

Optionally, said stream of particles comprises electrons that impinge upon the rotating target sub-assembly to produce X-rays. Optionally, the energy of the electrons is 6 MV or higher.

Optionally, the target is a ring made of tungsten.

Optionally, the target assembly further comprises one or more flow directors for directing the stream of liquid in a predefined direction and for propelling the plurality of paddles.

Optionally, said liquid is water. Optionally, the at least one coupling is a ferro-fluidic coupling for providing vacuum sealing.

In some embodiments, the present specification discloses a high power radiation production target assembly comprising: a target sub-assembly having a copper body and a target along a periphery of the copper body, wherein said target is impinged by a stream of particles to produce radiation; a stream of liquid used to cool said copper body; a direct motor drive configured to cause rotation of the copper body; and, a coupling to provide vacuum sealing under rotation.

Optionally, said stream of particles is an electron beam that impinges upon the rotating target to produce X-rays. Optionally, the energy of the electrons is 6 MV or higher.

Optionally, the target is a ring made of tungsten.

Optionally, the direct motor drive comprises a brushless torque motor.

Optionally, said liquid is water.

Optionally, the coupling is a ferro-fluidic coupling for providing vacuum to water sealing.

In some embodiments, the present specification discloses a high power radiation production target assembly comprising: a target sub-assembly having a copper body and a target along a periphery of the target body, wherein said target is impinged by a stream of particles to produce radiation; a stream of liquid used to cool said copper body; a chain drive motor configured to cause rotation of the copper body; and, a coupling to provide vacuum sealing.

Optionally, said stream of particles is an electron beam that impinges upon the rotating target to produce X-rays. Optionally, the energy of the electrons is 6 MV or higher.

Optionally, the target is a ring made of tungsten.

Optionally, the chain drive motor is operated in conjunction with one of: a chain, a timing belt, a continuous cable, and a direct spur-gear coupling.

Optionally, said liquid is water.

Optionally, the coupling is a ferro-fluidic coupling for providing vacuum to water sealing.

In some embodiments, the present specification discloses a method of continuously operating a radiation production target assembly comprising: rotating a target, wherein said target is formed on a periphery of a copper body, and wherein said target is rotated using a mechanism for causing rotation; impinging a stream of particles onto the rotating target to produce radiation; and circulating a cooling liquid around the target, such that the liquid is always in contact with at least one surface of the target for dissipating heat generated by the impinging stream of particles, thereby cooling the target to allow for continuous operation, wherein the target assembly comprises a coupling to provide vacuum sealing.

Optionally, the mechanism for rotating the target comprises a plurality of paddles attached to said copper body, wherein said paddles are propelled by a jet stream of said cooling liquid, thereby causing rotation of the target.

Optionally, the mechanism for rotating the target comprises a direct motor drive attached to said target assembly, said motor comprising a brushless torque motor.

Optionally, the mechanism for rotating the target comprises a chain drive motor attached to said target assembly. Optionally, the chain drive motor is operated in conjunction with one of: a chain, a timing belt, a continuous cable, and a direct spur-gear coupling.

Optionally, said stream of particles is an electron beam that impinges upon the rotating target to produce X-rays. Optionally, the energy of the electrons is 6 MV or higher.

Optionally, the target is a ring made of tungsten.

Optionally, said cooling liquid is water.

Optionally, the coupling is a ferro-fluidic coupling for providing vacuum to water sealing.

In some embodiments, the present specification describes a high power radiation source comprising a rotating target assembly being cooled by circulation of a liquid in contact with the assembly, the assembly comprising: a target, wherein said target is impinged by particles to produce radiation; a plurality of paddles attached to said target assembly, wherein said paddles are propelled by a jet stream of the liquid causing rotation of the target; and, at least one coupling to provide water to vacuum sealing. Optionally, the target assembly further comprises one or more flow directors for directing the jet stream of the liquid material in a predefined direction and for propelling the plurality of paddles.

In some embodiments, the present specification discloses a high power radiation source comprising a rotating target assembly being cooled by circulation of a liquid in contact with the assembly, the assembly comprising: a target, wherein said target is impinged by particles to produce radiation; a direct motor drive attached to said target assembly causing rotation of the target assembly; and, a coupling to provide water to vacuum sealing. Optionally, the direct motor drive comprises a brushless torque motor.

In some embodiments, the present specification discloses a high power radiation source comprising a rotating target assembly being cooled by circulation of a liquid in contact with the assembly, the assembly comprising: a target, wherein said target is impinged by particles to produce radiation; a chain drive motor attached to said target assembly causing rotation of the target assembly; and, a coupling to provide water to vacuum sealing. Optionally, the chain drive motor is operated in conjunction with one of: a chain, a timing belt and a continuous cable.

In some embodiments, the present specification discloses a method of operating a continuous radiation source using a rotating target assembly comprising: rotating a target, wherein said target is rotated using a mechanism for causing rotation; directing a particle stream onto the rotating target to produce radiation; circulating a liquid in contact with the target assembly to cool the target; and, a coupling to provide water to vacuum sealing. Optionally, the mechanism for rotating the target comprises a plurality of paddles attached to said target assembly, wherein said paddles are propelled by a jet stream of the liquid causing rotation of the target. Optionally, the mechanism for rotating the target comprises a direct motor drive attached to said target assembly comprising a brushless torque motor causing rotation of the target. Optionally, the mechanism for rotating the target comprises a chain drive motor attached to said target assembly causing rotation of the target. Optionally, the chain drive motor is operated in conjunction with one of: a chain, a timing belt and a continuous belt. Optionally, the particles are electrons impinging upon said target to produce X-rays. Optionally, the target is made of tungsten.

In some embodiments, the present specification discloses a high power radiation source comprising a rotating target assembly being cooled by circulation of a liquid in contact with the assembly, the assembly comprising: a target, wherein said target is impinged by particles to produce radiation; and, a plurality of paddles attached to said target assembly, wherein said paddles are propelled by a jet stream of the liquid causing rotation of the target.

Optionally, the high power radiation source further comprises a coupling to provide water to vacuum sealing. Optionally, the coupling is a dynamic ferro-fluidic coupling for providing water to vacuum sealing. Optionally, the high power radiation source further comprises at least one coupling to provide sealing to separate between water and vacuum, water and air, or vacuum and air.

The aforementioned and other embodiments of the present specification shall be described in greater depth in the drawings and detailed description provided below.

BRIEF DESCRIPTION OF THE DRAWINGS

These and other features and advantages of the present specification will be appreciated, as they become better understood by reference to the following detailed description when considered in connection with the accompanying drawings, wherein.

DETAILED DESCRIPTION

Figure 1:
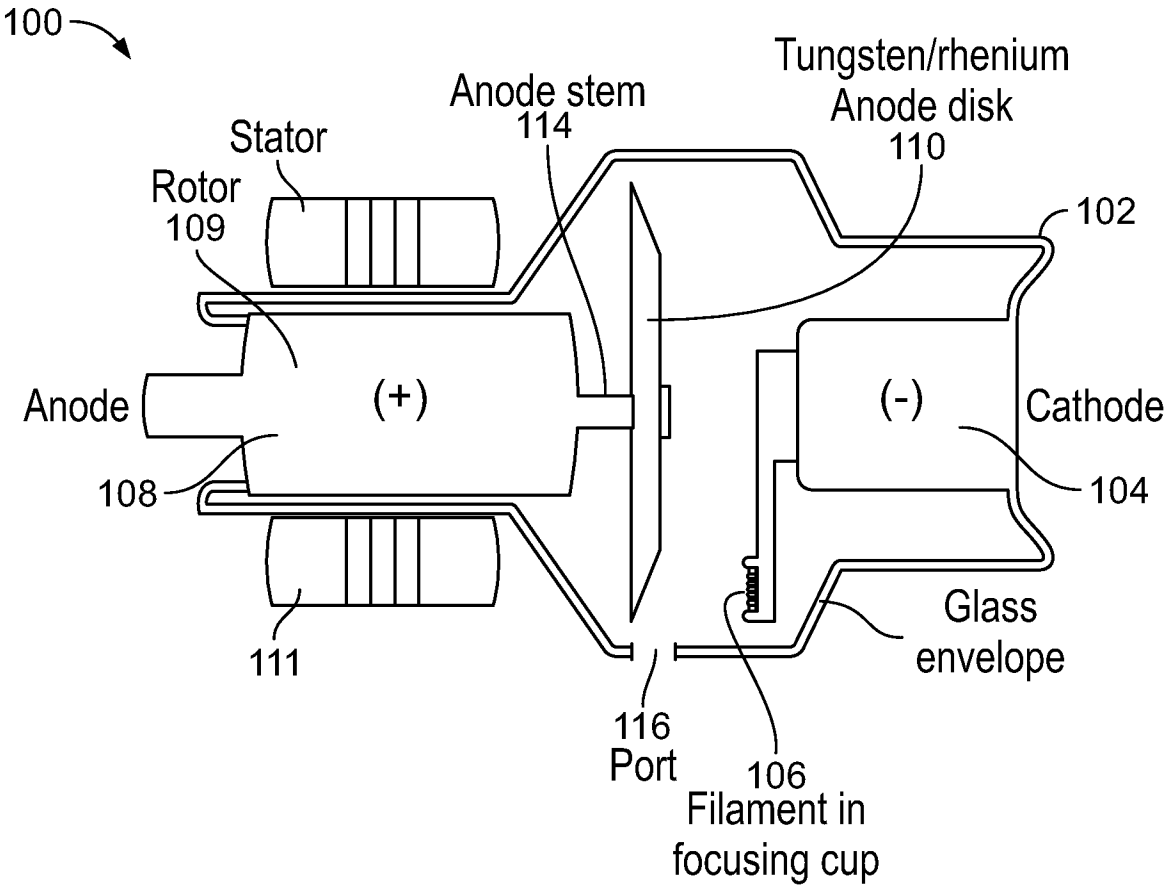
FIG. 1 PRIOR ART
FIG. 1 illustrates a conventional rotating anode X-ray tube 100 used in medical applications.
Figure 2:
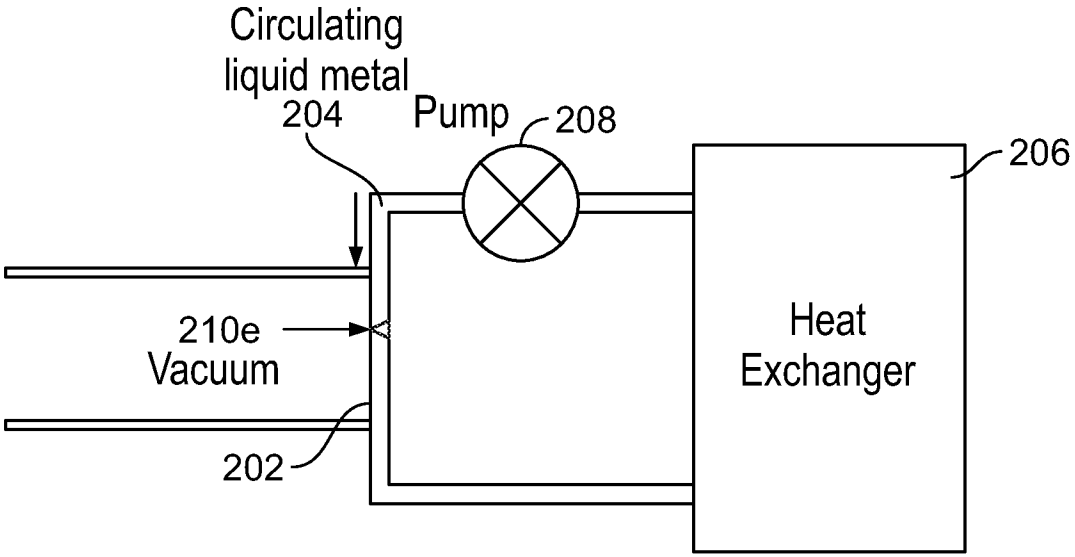
FIG. 2 PRIOR ART
FIG. 2 illustrates a liquid-metal target assembly for use in a high-power X-ray source.

The present specification describes several embodiments of high-power, rotating X-ray production targets. In various embodiments, the target is fabricated from a ring of tungsten brazed to a copper body, rotating at a high speed and cooled down by use of a high-speed flow of chilled water. In embodiments, the speed of the flow of water ranges between 100 RPM and 5000 RPM. In embodiments, the speed of the flow of water varies based on target material thickness, target material type, beam current, and cooling temperature. In an embodiment, the jet stream of water used for cooling the target is also used to rotate the target. Further, in embodiments, a target sub-assembly is connected to the electron accelerator, via physical interfaces, using an O-ring or gasket. A cooling liquid, such as water or a water and glycol mixture, is always in contact with at least one surface of the target for dissipating the heat generated by the energy deposited by the stream of electrons, thereby lowering the temperature of the target and allowing for continuous operation.

The term "high power" for a radiation production target assembly refers to a target assembly configured to generate at least 2 kW and up to 100 kW of X-ray radiation. The embodiments of the present specification are employed for target assemblies that operate in a power or energy ranging from 2 kW and 20 kW. Design of the target assemblies depends on both the required power and an optimization of the required power with corresponding size of the target assemblies. It should be appreciated that the power capability of the target assemblies of the present specification can be increased by making the X-ray production target assembly larger.

The present specification is directed towards multiple embodiments. The following disclosure is provided in order to enable a person having ordinary skill in the art to practice the invention. Language used in this specification should not be interpreted as a general disavowal of any one specific embodiment or used to limit the claims beyond the meaning of the terms used therein. The general principles defined herein may be applied to other embodiments and applications without departing from the spirit and scope of the invention. Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention. In the description and claims of the application, each of the words "comprise" "include" and "have", and forms thereof, are not necessarily limited to members in a list with which the words may be associated.

It should be noted herein that any feature or component described in association with a specific embodiment may be used and implemented with any other embodiment unless clearly indicated otherwise.

Figure 3A:
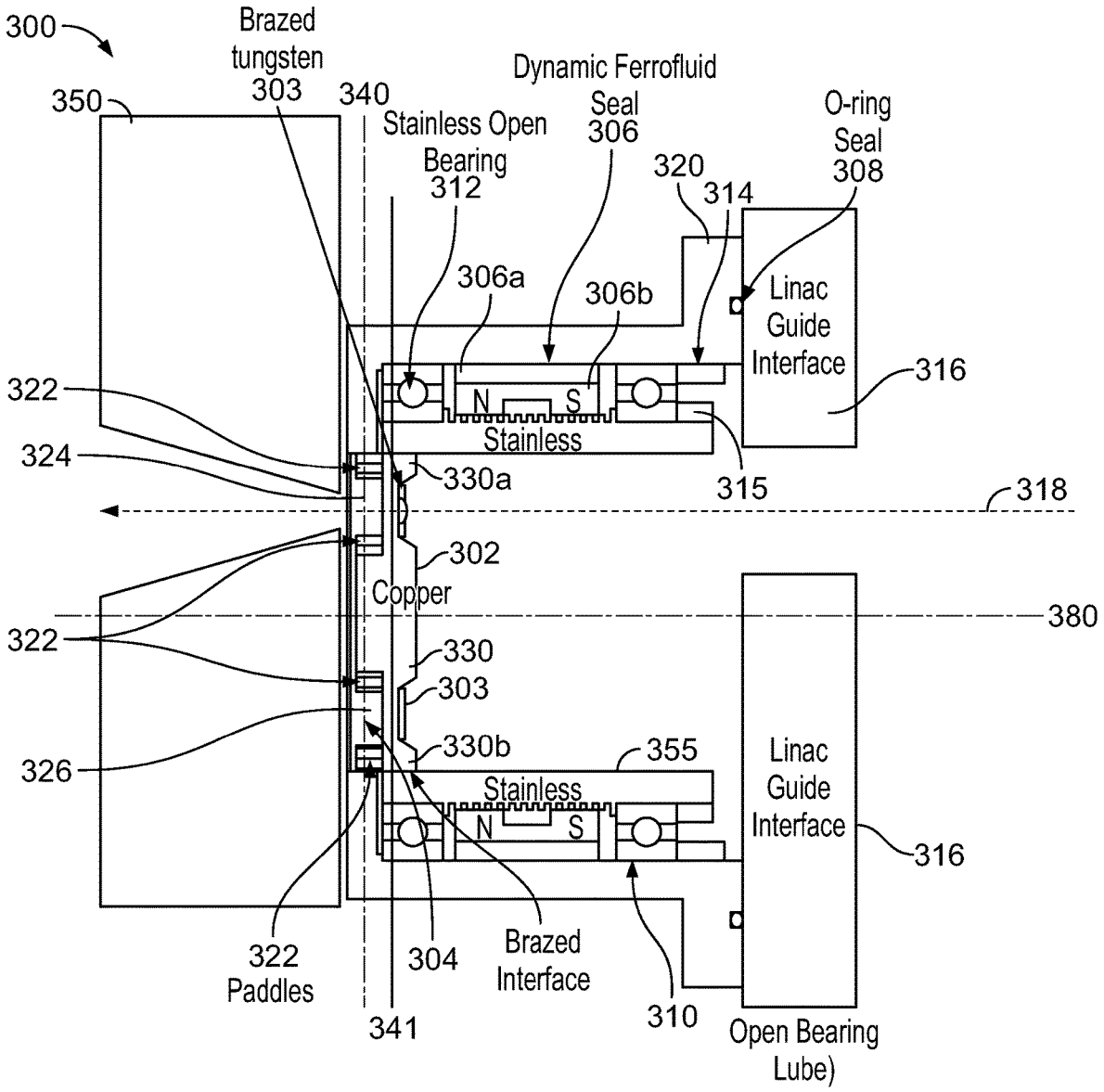
FIG. 3A is a side cross-sectional view of an X-ray production target assembly comprising a target sub-assembly propelled by a water jet, in accordance with an embodiment of the present specification.
Figure 3B:
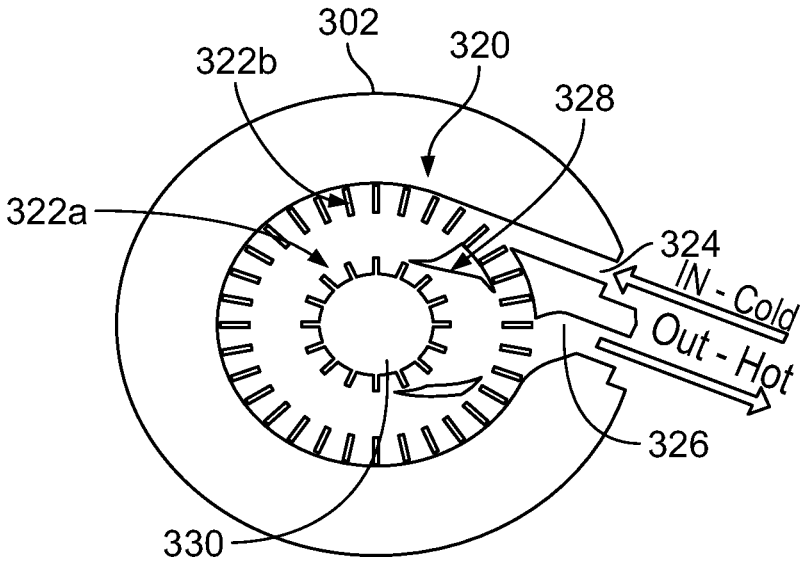
FIG. 3B is a front cross-sectional view of a portion of the X-ray target sub-assembly of FIG. 3A, in accordance with an embodiment of the present specification.

FIG. 3A illustrates a side cross-sectional view of an X-ray production target assembly 300 comprising a target sub-assembly 302 which includes a target propelled and cooled by a water jet, in accordance with an embodiment of the present specification. FIG. 3B illustrates an exploded, front cross-sectional view, through a line 340 of FIG. 3A, of a portion of the target sub-assembly 302, in accordance with an embodiment of the present specification. Referring to FIGS. 3A and 3B, the target sub-assembly 302 comprises a copper body 330 that supports a target ring 303 brazed into the copper body 330. In an embodiment, the target ring 303 comprises a tungsten ring. However, in alternate embodiments, for energies above approximately 7.5 MeV the copper body 330 is used as a target when neutron production is not desired. In some embodiments, the copper body 330 is disc shaped and may optionally include a protruding center wheel portion. In embodiments, the target ring 303 may be positioned around the center wheel portion of copper body 330. The target ring 303 is positioned along an edge or periphery of the copper body 330, wherein the target sub-assembly 302 or portions thereof directly oppose an electron source or electron accelerator, such as, for example, a linac. The copper body 330 is housed within a hollow stainless steel cylinder 355. In an embodiment, top portion 330*a* and bottom portion 330*b* of the copper body 330 is brazed to an inner surface of the hollow cylinder 355. A target enclosure 320 houses the target sub-assembly 302. In embodiments, the target enclosure is comprised of a thin material that does not significantly attenuate X-rays.

Rotation of the target sub-assembly 302 and the cylinder 355, about a central longitudinal axis 380, is enabled by a first bearing 310 (in vacuum) and a second bearing 312 disposed between the cylinder 355 and the enclosure 320. In some embodiments, the first and second bearings 310, 312 are radial open bearings of stainless steel having a plurality of balls sandwiched between a stationary portion and a rotatory portion. The stationary portions of the bearings 310, 312 are attached to an inner surface of the enclosure 320 while the rotatory portions of the bearings 310, 312 are coupled to and rest on an outer surface of the cylinder 355. A dynamic Ferro-fluid coupling or seal 306, which, in an embodiment comprises first and second portions 306*a* and 306*b*, is also positioned between the cylinder 355 and the enclosure 320. In some embodiments, two ferro-fluidic couplings may be employed. In some embodiments, only one ferro-fluidic coupling is employed. A static O-ring 308, positioned at a distal end or periphery of the enclosure 320, serves as a vacuum/air seal between the target sub-assembly 302 electron source interfaces 316 which abut the enclosure 320. A retaining member or threaded nut bearing 314 is coupled to the inner surface of the enclosure 320 while retaining member 315 is coupled to the outer surface of the cylinder 355. As shown in FIG. 3A, the second bearing 312 is positioned proximal to a vertical plane 341 positioned through the copper body 330, the first bearing 310 is positioned distal to the vertical plane 341 through the copper body 330. In embodiments, the Ferro-fluidic coupling 306 is positioned between the first and second bearings 310, 312. The threaded nut bearing 314 and retaining member 315 are disposed distal to and abutting the first bearing 310. Threaded nut bearing 314 and retaining member 315 allow for one bearing to be movably attached so that it can be adjusted in case of misalignment. In an alternative embodiment, a single bearing may be employed. Ideally, if a single bearing is employed, it should be able to withstand moment forces. In an embodiment, where a single bearing is employed, it may be placed at a position proximal to a vertical plane 341 of the copper body 330. Persons of ordinary skill in the art would appreciate that the current arrangement of the bearings 310, 312, 314 and the Ferro-fluidic coupling 306 is only exemplary and may differ in alternate embodiments.

Still referring to FIGS. 3A and 3B, the target sub-assembly 302 also comprises a plurality of paddles 322 configured as radially elongated members. In embodiments, the paddle size is dependent on the overall size of the target. In embodiments, the plurality of paddles 322 is coupled to the copper body 330. In embodiments, paddles 322 are coupled to the copper body via any suitable adhering means, such as, but not limited to machining, gluing, or welding. In embodiments, any two consecutive paddles are spaced at a distance from one another wherein the distance ranges from a first value to a second value. In embodiments, it should be noted that the distance between the paddles 322 is dependent on the overall size of the target and target sub-assembly. In some embodiments, the plurality of paddles 322 are configured as first and second concentric rings 322*a*, 322*b* positioned behind the copper body 330 relative to the plane of the copper body 330. It should be understood by those of ordinary skill in the art that the X-ray production target assembly 300 is positioned between the electron source interfaces 316 and collimators 350 of an X-ray source assembly (not shown in its entirety). It should be noted herein that an electron accelerator, which may be part of the X-ray source assembly, may be employed in embodiments of the present specification. In embodiments, the electron accelerator may be a tube for operating energies of less than 600 kV. In embodiments, the electron accelerator may be a linac for operating energies of greater than 1 MeV and for generating high energy electrons.

In accordance with an aspect of the present specification, the target sub-assembly 302 is cooled by a flow of circulating water 304. In operation, a stationary electron beam 318 is directed to the periphery of the copper body 330 such that is impinges upon the target ring 303. In some embodiments, the energy of the electrons in the electron beam 318 is on the order of 6 MV or higher. When the electron beam 318 hits the target ring 303, which rotates via water flow, X-rays are produced and the energy deposited by the electrons is spread around the rotating target's ring 303. Cold water flowing into the enclosure 320 via conduit or opening 324 strikes concentric rings 322*a* and 322*b*, comprising paddles 322, thus rotating the copper body 330 and concurrently cooling the target sub-assembly 302. After cooling the target sub-assembly 302, the heated water flows out of the enclosure 320 via conduit or opening 326 to a chiller to cool the water. Flow directors 328 are provided to guide the flow of water in a desired direction. In an embodiment, the target sub-assembly 302 is propelled by a jet of water at a pressure of approximately 100 psi.

Figure 4A:
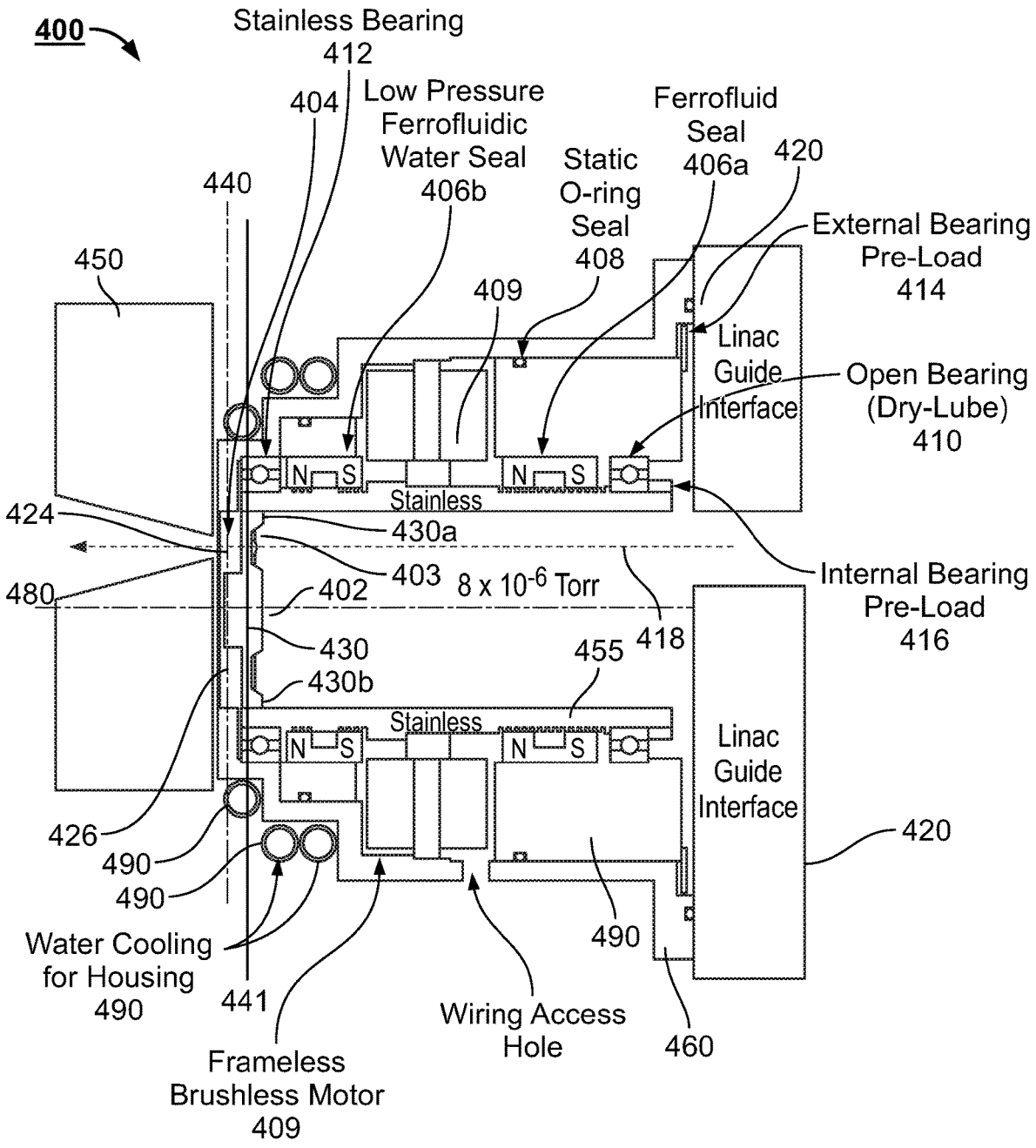
FIG. 4A illustrates a side cross-sectional view of an X-ray production target assembly comprising a target sub-assembly rotated via a direct drive motor, in accordance with an embodiment of the present specification.
Figure 4B:
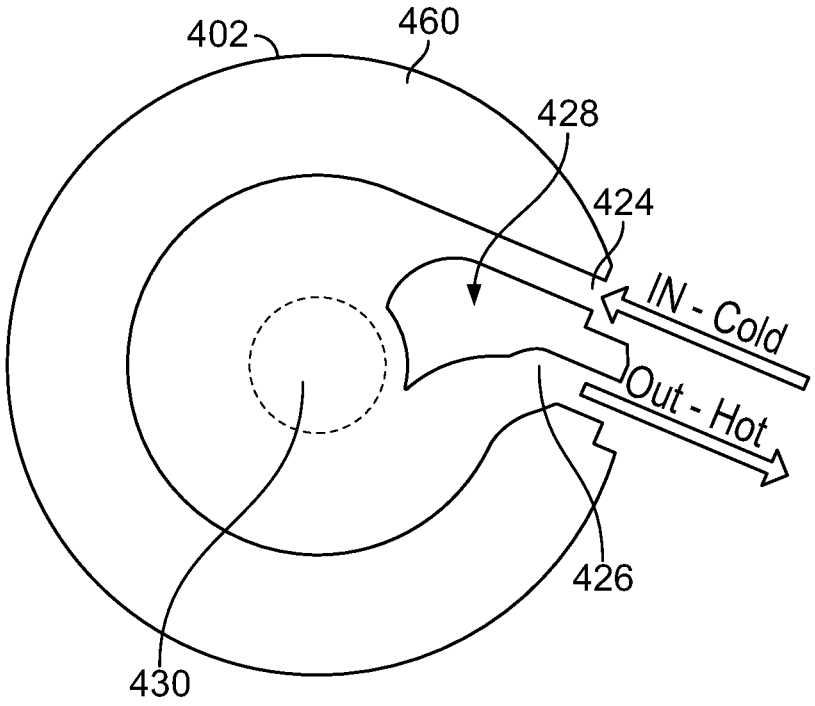
FIG. 4B is a front cross-sectional view of a portion of the X-ray target sub-assembly of FIG. 4A, in accordance with an embodiment of the present specification.

FIG. 4A illustrates a side cross-sectional view of an X-ray production target assembly 400 comprising a target sub-assembly 402 that is rotated via a direct drive motor, in accordance with an embodiment of the present specification. FIG. 4B illustrates a front cross-sectional view, through a line 440 of FIG. 4A, of a portion of the target sub-assembly 402 cooled by flowing water, in accordance with an embodiment of the present specification. Referring to FIGS. 4A and 4B, the target sub-assembly 402 comprises a copper body 430 that supports a target ring 403 brazed into the copper body 430. In an embodiment, the target ring 403 comprises a tungsten ring. However, in alternate embodiments, for energies above approximately 7.5 MeV the copper body 430 is used as a target when neutron production is not desired. In some embodiments, the copper body 430 is disc shaped and may optionally include a protruding center wheel portion. In embodiments, the target ring 403 may be positioned around the center wheel portion of copper body 430. In embodiments, the tungsten ring 403 is positioned along an edge or periphery of the copper body 430, wherein the target sub-assembly 402 or portions thereof directly oppose an electron source, such as, for example, a linac. The copper body 430 is housed within a hollow stainless steel cylinder 455. In an embodiment, top portion 430*a* and bottom portion 430*b* of the copper body 430 is brazed to an inner surface of the hollow cylinder 455. A target enclosure 460 houses the target sub-assembly 402. In embodiments, the target enclosure is comprised of a thin material that does not significantly attenuate X-rays.

At least one, and preferably a first ferro-fluidic seal 406*a* and a second ferro-fluidic seal 406*b* are also positioned between the cylinder 455 and the target enclosure 460 to provide vacuum to motor/air sealing as well as motor/air to water sealing. At least one static O-ring 408 serves as a vacuum/air seal between the target sub-assembly 402 and electron-source interfaces 420 which abut the target enclosure 460. Optionally, two static O-ring seals 408 are employed and serve as vacuum/air seals between the target sub-assembly 402 and the target enclosure 460.

Rotation of the target sub-assembly 402 and the cylinder 455, about a central longitudinal axis 480, is enabled by a first bearing 410 and a second bearing 412 positioned between the hollow cylinder 455 and the target enclosure 460. In some embodiments, the first and second bearings 410, 412 are radial open bearings of stainless steel having a plurality of balls sandwiched between a stationary portion and a rotatory portion. The second bearing 412 is disposed proximal to a vertical plane 441 of the copper body 430, the first bearing 410 is disposed distal to the vertical plane 441 of the copper body 430. In an embodiment, first bearing 410 is positioned on a distal side of first ferro-fluidic seal 406*a* and second bearing 412 is positioned on a proximal side of second ferro-fluidic seal 406*b*, wherein said distal and proximal sides are defined in relation to a vertical plane 441 through copper body 430, with the proximal position being closer to the vertical plane 441 while the distal position is farther from the vertical plane 441. Thus, in the embodiment just described, first and second bearings 410, 412 "sandwich" the first and second ferro-fluidic seals 406*a*, 406*b* to provide vacuum sealing under rotation. In an alternate embodiment, first bearing 410 may be positioned in air on a proximal side of a first ferro-fluidic seal 406*a* while second bearing 412 may be positioned in air on a distal side of a second ferro-fluidic seal 406*b*, whereby first and second bearings 410, 412 are "sandwiched" in air between the first and second ferro-fluidic seals 406*a*, 406*b*. In an alternative embodiment, a single bearing may be employed. Ideally, if a single bearing is employed, it should be able to withstand moment forces. In an embodiment where a single bearing is employed, it may be either first bearing 410 positioned in air on a proximal side of a first ferro-fluidic seal 406*a* or second bearing 412 positioned in air on a distal side of a second ferro-fluidic seal 406*b*.

The stationary portion of the bearing 410 is attached to a structural member 490 while the stationary portion of the bearing 412 is attached to an inner surface of the target enclosure 460. The rotatory portions of the bearings 410, 412 are coupled to and rest on an outer surface of the cylinder 455. An external bearing retaining member 414 is positioned on the periphery of the enclosure 460 at a distal end while an internal bearing retaining member 416 is coupled to the outer surface of the cylinder 455. The internal bearing retaining member 416 is positioned distally to the bearing 410 while the external bearing retaining member 414 is positioned distally to the internal bearing retaining member 416 and proximate the periphery of the enclosure 460. Bearing retaining members 414 and 416 allow for one bearing to be movably attached so that it can be adjusted in case of misalignment. Persons of ordinary skill in the art would appreciate that the current arrangement of the bearings 410, 412, and the two ferro-fluidic seals 406*a*, 406*b* is only exemplary and may differ in alternate embodiments.

A direct motor drive comprising a brushless torque motor 409 is provided directly on and attached to the target sub-assembly 402 to cause the sub-assembly 402 (and therefore the copper body 430) and the cylinder 455 to rotate. In an embodiment, the target sub-assembly 402 can be brazed to a stainless motor rotor where permanent magnets are bonded to the rotor. It should be understood by those of ordinary skill in the art that the X-ray production target assembly 400 is positioned between the electron-source interfaces 420 and collimators 450 of an X-ray source assembly (not shown in its entirety) that may, in an embodiment, include a linac for generating high-energy electrons.

In accordance with an aspect of the present specification, the target sub-assembly 402 is cooled by circulating water 404 while the sub-assembly 402, and therefore the copper body 430, is being rotated by the motor 409. In operation, a stationary electron beam 418 is directed to the periphery of the copper body 430 and impinges upon the target ring 403. In some embodiments, energy of electrons in the electron beam 418 is on the order of 6 MV or higher. When the electron beam 418 hits the target ring 403, which is being rotated by the motor 409, X-rays are produced and the energy deposited by the electrons is spread around the target's tungsten ring 403. In an embodiment, for example, an allied motion model HTO5000 brushless motor may be employed to rotate the target and circulate the water. In other embodiments, any suitable brushless torque motor may be used. Further, depending on the actual configuration, the motor may modify the electron beam trajectory due to the electrical and magnetic fields induced by the motor. Referring back to FIGS. 4A and 4B, the target sub-assembly 402 is cooled by cold water flowing through the enclosure 460 via conduit or opening 424, circulating and cooling the target sub-assembly 402. Heated water flows out of the enclosure 460 via conduit or opening 426 to a chiller to cool the hot water. Flow directors 428 are provided to guide the flow of water in a desired direction. In embodiments, at least one tube 490 is employed to cool the target enclosure or housing 460 with water. Optionally, three tubes 490 are employed.

Figure 5A:
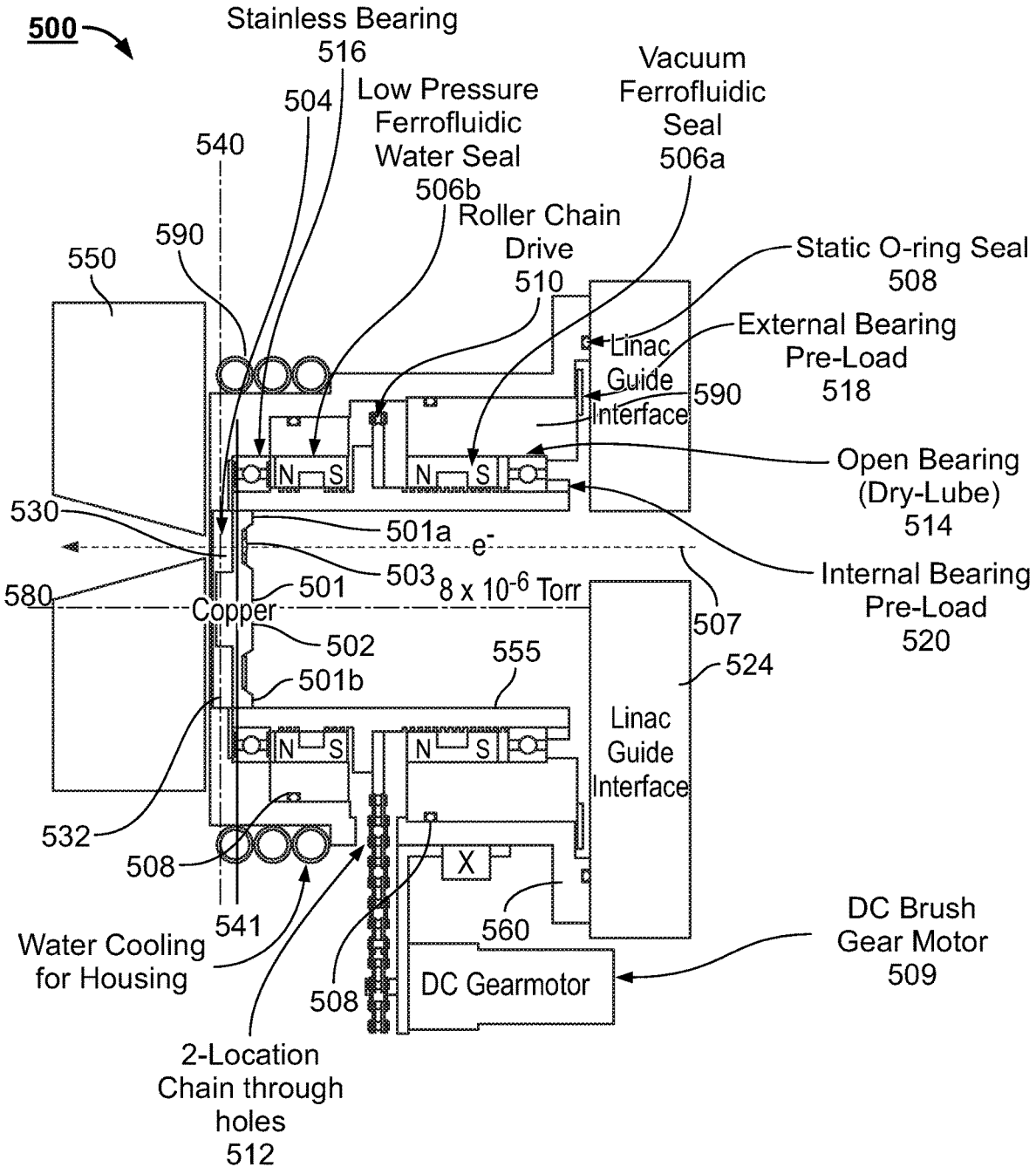
FIG. 5A illustrates a side cross-sectional view of an X-ray production target assembly comprising a target sub-assembly rotated via a chain motor drive, in accordance with an embodiment of the present specification.
Figure 5B:
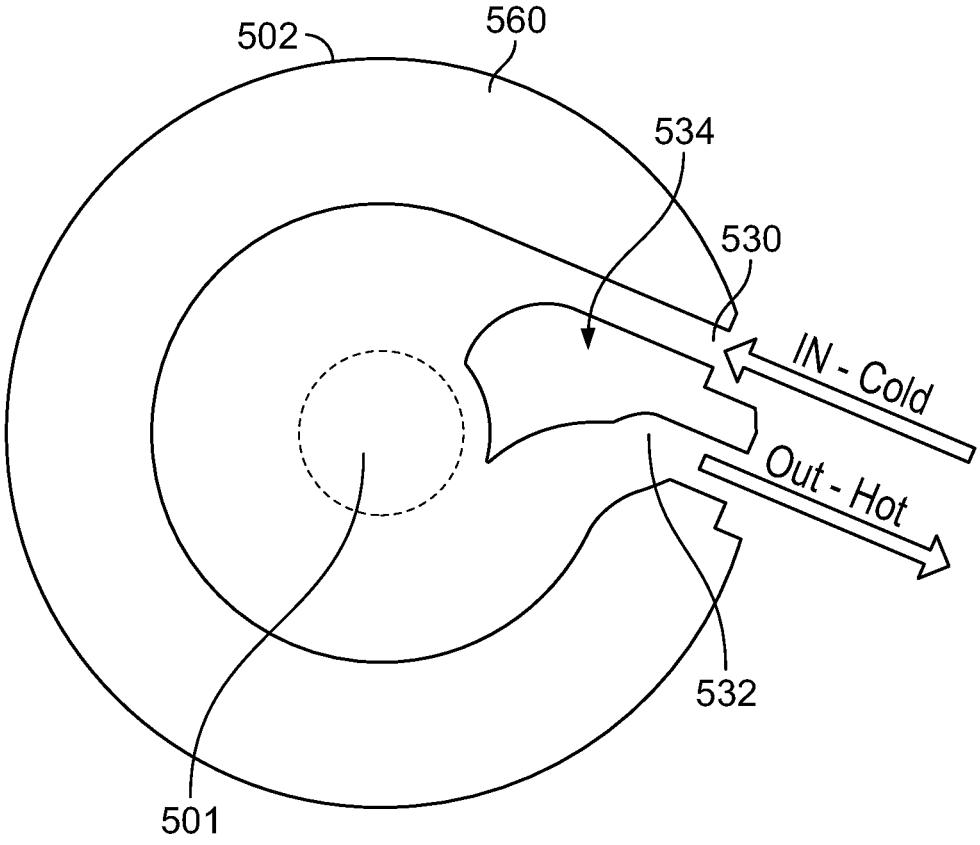
FIG. 5B is front cross-sectional view of a portion of the X-ray target sub-assembly of FIG. 5A, in accordance with an embodiment of the present specification.

FIG. 5A illustrates a side cross-sectional view of an X-ray production target assembly 500 comprising a target sub-assembly 502 rotated via a motor drive, in accordance with an embodiment of the present specification. FIG. 5B illustrates a front cross-sectional view, through a line 540 of FIG. 5A, of a portion of the target sub-assembly 502 cooled by flowing water, in accordance with an embodiment of the present specification. Referring to FIGS. 5A and 5B, the target sub-assembly 502 comprises a copper body 501 that supports a target ring 503 brazed in the copper body 501. In an embodiment, the target ring 503 is comprised of a tungsten ring. However, in alternate embodiments, for energies above approximately 7.5 MeV the copper body 501 may be used as a target when neutron production is not desired. In some embodiments, the copper body 501 is disc shaped and may optionally include a protruding center wheel portion. In embodiments, the target ring 503 may be positioned around the center wheel portion of copper body 501. In embodiments, the tungsten ring 503 is positioned along an edge or periphery of the copper body 501, wherein the target sub-assembly 502 or portions thereof directly oppose an electron source, such as, for example, a linac. The copper body 501 is housed within a hollow stainless steel cylinder 555. In an embodiment, top portion 501*a* and bottom portion 501*b* of the copper body 501 is brazed to an inner surface of the hollow cylinder 455. A target enclosure 560 houses the target sub-assembly 502. In embodiments, the target enclosure is comprised of a thin material that does not significantly attenuate X-rays.

At least one, and preferably a first ferro-fluidic seal 506*a* and a second ferro-fluidic seal 506*b* are also positioned between the cylinder 555 and the target enclosure 560 to provide vacuum to motor/air sealing as well as motor/air to water sealing. At least one static O-ring 508 serves as a vacuum/air seal between the target sub-assembly 502 and electron-source interfaces 524 which abut the target enclosure 560. Optionally, two static O-ring seals 508 are employed and serve as vacuum/air seals between the target sub-assembly 502 and the target enclosure 560.

Rotation of the target sub-assembly 502 and the cylinder 555, about a central longitudinal axis 580, is enabled by a first bearing 514 and a second bearing 516 disposed between the cylinder 555 and the enclosure 560. In some embodiments, the first and second bearings 514, 516 are radial open bearings of stainless steel having a plurality of balls sandwiched between a stationary portion and a rotatory portion. The second bearing 516 is disposed proximal to a vertical plane of the copper body 501, the first bearing 514 is disposed distal to the vertical plane of the copper body 501.

In an embodiment, first bearing 514 is positioned on a distal side of first ferro-fluidic seal 506*a* and second bearing 516 is positioned on a proximal side of second ferro-fluidic seal 506*b*, wherein said distal and proximal sides are defined in relation to a vertical plane 541 through copper body 501, with the proximal position being closer to the vertical plane 541 while the distal position is farther from the vertical plane 541. Thus, in the embodiment just described, first and second bearings 514, 516 "sandwich" the first and second ferro-fluidic seals 506*a*, 506*b*. In an alternate embodiment, first bearing 514 may be positioned in air on a proximal side of a first ferro-fluidic seal 506*a* while second bearing 516 may be positioned in air on a distal side of a second ferro-fluidic seal 506*b*, whereby first and second bearings 514, 516 are "sandwiched" in air between the first and second ferro-fluidic seals 506*a*, 506*b*. In an alternative embodiment, a single bearing may be employed. Ideally, if a single bearing is employed, it should be able to withstand moment forces. In an embodiment where a single bearing is employed, it may be either first bearing 514 positioned in air on a proximal side of a first ferro-fluidic seal 506*a* or second bearing 516 positioned in air on a distal side of a second ferro-fluidic seal 506*b*.

The stationary portion of the bearing 514 is attached to a structural member 590 while the stationary portion of the bearing 516 is attached to an inner surface of the enclosure 560. The rotatory portions of the bearings 514, 516 are coupled to and rest on an outer surface of the cylinder 555. An external bearing retaining member 518 is positioned proximal to a periphery of the enclosure 560 while an internal bearing retaining member 520 is coupled to the outer surface of the cylinder 555. Bearing retaining members 518 and 520 allow for one bearing to be movably attached so that it can be adjusted in case of misalignment. Persons of ordinary skill in the art would appreciate that the current arrangement of the bearings 514, 516, and the two ferro-fluidic seals 506*a*, 506*b* is only exemplary and may differ in alternate embodiments. Also, the internal bearing retaining member 520 is positioned distal to the bearing 514 while the external bearing retaining member 518 is positioned distal to the internal bearing retaining member 520 and proximate the periphery of the enclosure 560.

The assembly 500 further comprises a DC brush gear motor 509, a roller chain drive 510 and chain 512, wherein the motor 509 is coupled to the target sub-assembly 502 to cause rotation of the sub-assembly 502 and the cylinder 555. In an embodiment, a number 25 size roller chain is used for a 5:1 chain gear ratio in conjunction with a size 16 DC brushed gear motor. In various embodiments, determination of the chain to gear ratio is based upon a desired target sub-assembly rotation speed and motor size/operating speed or running torque.

It should be understood by those of ordinary skill in the art that the X-ray production target assembly 500 is positioned between the electron-source interfaces 524 and collimators 550 of an X-ray source assembly (not shown in its entirety) that optionally includes a linac for generating high-energy electrons.

In accordance with an aspect of the present specification, the target sub-assembly 502 is cooled by circulating water 504 while the sub-assembly 502 is being rotated by the motor 509. In operation, a stationary electron beam 507 is directed to the periphery of the copper body 501 and impinges upon the tungsten ring 503. In some embodiments, energy of electrons in the electron beam 507 is on the order of 6 MV or higher. When the electron beam 507 hits the tungsten ring 503, which is being rotated by the motor 509, X-rays are produced and the energy deposited by the electrons is spread around the target's tungsten ring 503. Since the motor 509 is attached to the chain 512 which in turn is coupled with the target sub-assembly 502 via chain drive 510, rotation of the motor 509 causes movement of the chain 512, which in turn causes rotation of the target sub-assembly 502 and therefore rotation of the copper body 501. In various embodiments, a timing belt, a continuous cable, friction drive, a series of spur gears or direct spur-gear couplings and any drive train which allows remoting the motor from the target shaft may be used instead of the chain 512. This embodiment overcomes the potential deviation of the electron trajectory, as the motor 509 is positioned at a distance from the electron beam 507 and therefore, the motor-induced magnetic and electrical fields do not disturb the electrons.

Referring back to FIGS. 5A and 5B, the target is cooled by cold water flowing in enclosure 560 via conduit 530, circulating and cooling the target sub-assembly 502. Heated water flows out of the enclosure 560 via conduit 532. Flow directors 534 are provided to guide the flow of water in a desired direction. In embodiments, at least one tube 590 is employed to cool the target enclosure or housing 560 with water. Optionally, three tubes 590 are employed.

Persons of ordinary skill in the art would appreciate that the above embodiments are merely illustrative of the many configurations of the target assemblies of present specification. In other embodiments, the target material may comprise pure copper or may be fabricated from other suitable materials such as, but not limited to, a combination of tungsten and rhenium. In addition, as described above, the bearings may be repositioned and placed in air. Alternatively, a single bearing which can resist a moment load (such as a cross-roller or four-point contact bearing) may be employed, thus eliminating the need for the second bearing. Further, other liquids may be used for cooling the target, such as a water and glycol mixture, which is suitable for conditions wherein the target is exposed to near freezing or frozen temperatures. In an embodiment, the water used for cooling the target may also contain corrosion inhibitors. In an embodiment, the target is hit by particle beams other than electrons, such as protons or deuterons. Also, in various embodiments, different types of vacuum seals may be used in place of the ferro-fluidic seal.

Figure 6:
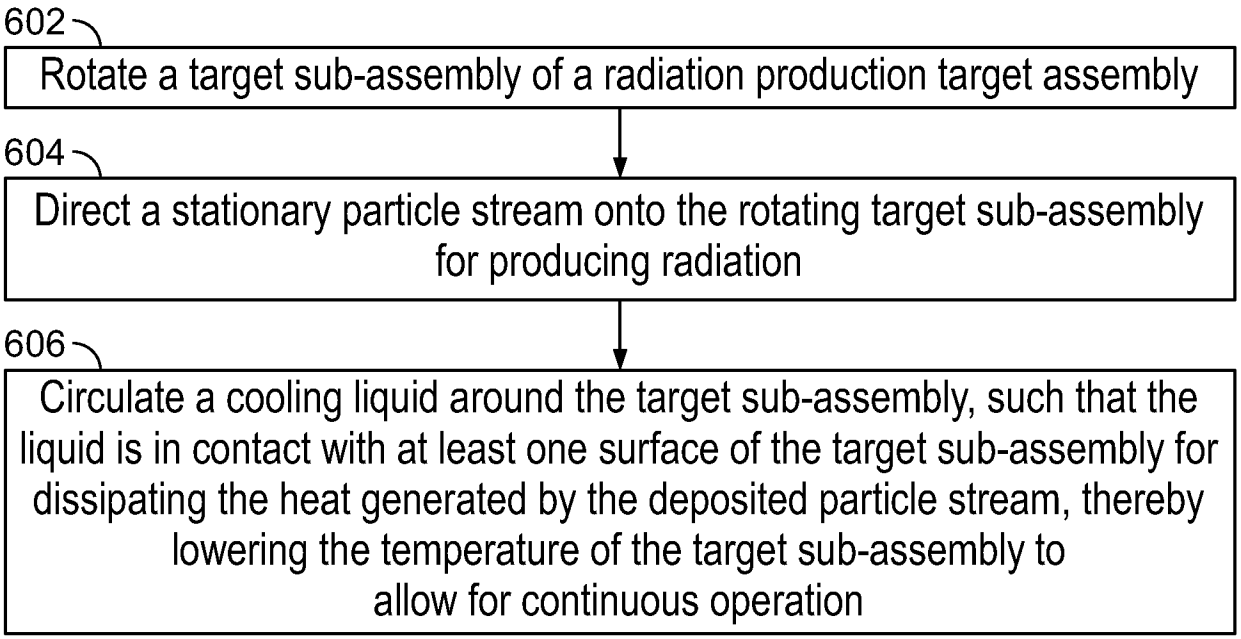
FIG. 6 is a flowchart illustrating the steps of operating a rotating radiation production target assembly, in accordance with an embodiment of the present specification.

FIG. 6 is a flowchart illustrating the steps of operating a rotating radiation production target sub-assembly, in accordance with an embodiment of the present specification. At step 602 a target of the radiation production target sub-assembly is rotated. In an embodiment, the target sub-assembly comprises a copper body that supports the target comprising a target ring brazed in the copper body. In an embodiment, the target ring is comprised of tungsten. In an embodiment, the target is rotated by propelling a jet stream of water at a set of paddles attached to the copper body. In another embodiment, the target is rotated by using a motor coupled with the target sub-assembly. In an embodiment, the motor is a direct motor drive comprising a brushless torque motor. In another embodiment, the motor comprises chain sprockets, threaded through which a chain, a timing belt, friction drive and a continuous cable move to rotate the target.

At step 604, a particle stream is directed toward the rotating target for producing radiation. In an embodiment, the particle stream is a stationary electron beam generated by an electron accelerator which produces X-rays upon hitting the tungsten ring portion of the rotating target.

At step 606, a cooling liquid is circulated around the target, such that the liquid is in contact with at least one surface of the target for dissipating the heat generated by the energy deposited by the stream of particles, thereby lowering the temperature of the target to allow for continuous operation. In an embodiment, the jet stream of water used for rotating the target is also used for cooling the target. In various embodiments, liquids such as but not limited to water or a water and glycol mixture may be used to cool the target.

In an embodiment, the continuously operable rotating X-ray production target assembly of the present specification may be integrated with security systems that can be deployed in locations such as, but not limited to, border control, sea ports, commercial buildings, and/or offices/office buildings.

The above examples are merely illustrative of the many applications of the system of present invention. Although only a few embodiments of the present invention have been described herein, it should be understood that the present invention might be embodied in many other specific forms without departing from the spirit or scope of the invention. Therefore, the present examples and embodiments are to be considered as illustrative and not restrictive, and the invention may be modified within the scope of the appended claims.

We claim:

1. A high power radiation production target assembly comprising:

a target sub-assembly having a copper body and a target positioned along a periphery of the copper body, wherein said target is configured to be impinged by a stream of particles to produce radiation;

a plurality of paddles positioned on said copper body;

a stream of liquid adapted to propel said paddles thereby causing a rotation and a cooling of said copper body; and, at least one coupling configured to provide vacuum sealing under rotation.

2. The high power radiation production target assembly of claim 1, wherein said stream of particles comprises electrons that impinge upon the rotating target to produce X-rays.

3. The high power radiation production target assembly of claim 2, wherein the electrons have an energy level and wherein the energy level is 6 MV or higher.

4. The high power radiation production target assembly of claim 1, wherein the target is a ring made of tungsten.

5. The high power radiation production target assembly of claim 1, wherein the target sub-assembly further comprises one or more flow directors configured to direct the stream of liquid in a predefined direction and to propel the plurality of paddles.

6. The high power radiation production target assembly of claim 1, wherein said liquid is water.

7. The high power radiation production target assembly of claim 1, wherein the at least one coupling is a ferro-fluidic coupling configured to provide the vacuum sealing.

8. A high power radiation production target assembly comprising:

a target sub-assembly having a copper body and a target along a periphery of the copper body, wherein said target is configured to be impinged by a stream of particles to produce radiation;

a stream of liquid adapted to cool said copper body;

a chain drive motor configured to cause a rotation of the copper body; and, a coupling configured to provide vacuum sealing.

9. The high power radiation production target assembly of claim 8, wherein said stream of particles comprises an electron beam configured to impinge upon the rotating copper body to produce X-rays.

10. The high power radiation production target assembly of claim 9, wherein the electrons have an energy level and wherein the energy level is 6 MV or higher.

11. The high power radiation production target assembly of claim 8, wherein the target is a ring made of tungsten.

12. The high power radiation production target assembly of claim 8, wherein the chain drive motor is configured to operate with at least one of a chain, a timing belt, a continuous cable, or a direct spur-gear coupling.

13. The high power radiation production target assembly of claim 8, wherein said liquid is water.

14. The high power radiation production target assembly of claim 8, wherein the coupling is a ferro-fluidic coupling configured to provide the vacuum sealing.

15. A method of continuously operating a radiation production target assembly comprising:

rotating a target, wherein said target is formed on a periphery of a copper body, and wherein said target is rotated using at least one of a plurality of paddles attached to the copper body, wherein the paddles are adapted to be propelled by a stream of cooling liquid, thereby causing a rotation of the target or a chain drive motor attached to the target;

impinging a stream of particles onto the rotating target to produce radiation; and circulating the cooling liquid around the target, such that the cooling liquid is in contact with at least one surface of the target for dissipating heat generated by the impinging stream of particles, thereby cooling the target and allowing for continuous operation, wherein the target assembly further comprises a coupling adapted to provide a vacuum seal.

16. The method of claim 15, wherein the chain drive motor is operated with at least one of a chain, a timing belt, a continuous cable, or a direct spur-gear coupling.

17. The method of claim 15, wherein said stream of particles comprises an electron beam that impinges upon the rotating target to produce X-rays.

18. The method of claim 17, wherein the electrons have an energy level and wherein the energy level is 6 MV or higher.

19. The method of claim 15, wherein the target is a ring made of tungsten.

20. The method of claim 15, wherein said cooling liquid is water.

21. The method of claim 15, wherein the coupling is a ferro-fluidic coupling.

* * * * *